US009145693B2

(12) United States Patent
Marandola, Jr.

(10) Patent No.: US 9,145,693 B2
(45) Date of Patent: Sep. 29, 2015

(54) TILE INSTALLATION TOOL

(71) Applicant: Orlando Marandola, Jr., St-Come (CA)

(72) Inventor: Orlando Marandola, Jr., St-Come (CA)

( * ) Notice: Subject to any disclaimer, the term of this patent is extended or adjusted under 35 U.S.C. 154(b) by 0 days.

(21) Appl. No.: 14/541,060

(22) Filed: Nov. 13, 2014

(65) Prior Publication Data

US 2015/0167322 A1 Jun. 18, 2015

(30) Foreign Application Priority Data

Dec. 18, 2013 (GB) ..... 1322394.6

(51) Int. Cl.
*E04B 1/00* (2006.01)
*E04F 21/02* (2006.01)
*E04F 21/24* (2006.01)

(52) U.S. Cl.
CPC ..... *E04F 21/023* (2013.01); *E04F 21/241* (2013.01)

(58) Field of Classification Search
CPC ..... B25H 7/02; E04F 21/18; E04F 21/023
USPC ..... 52/749.11, 127.2, 127.3
See application file for complete search history.

(56) References Cited

U.S. PATENT DOCUMENTS

| | | | | |
|---|---|---|---|---|
| 823,874 | A | 6/1906 | Jones | |
| 999,770 | A | 8/1911 | Fogertey | |
| 1,118,067 | A | 11/1914 | Smith | |
| 1,241,611 | A | 10/1917 | Drake | |
| 1,619,091 | A * | 3/1927 | Rieser | 33/454 |
| 2,144,697 | A | 1/1939 | Zangrando | |
| 2,619,173 | A | 11/1952 | Millard | |
| 2,642,674 | A | 6/1953 | Schell, Jr. | |
| D182,193 | S | 2/1958 | Minors | |
| 3,643,335 | A | 2/1972 | Smith | |
| 3,775,856 | A | 12/1973 | Schmidt | |
| 3,875,664 | A | 4/1975 | Diner | |
| D246,512 | S | 11/1977 | McFarland | |
| D287,475 | S | 12/1986 | Jordan | |
| D316,803 | S | 5/1991 | Newman | |
| D348,226 | S | 6/1994 | Alaniz | |
| 5,359,783 | A | 11/1994 | Smith | |
| 5,361,508 | A | 11/1994 | Ruggiero | |

(Continued)

FOREIGN PATENT DOCUMENTS

| | | | |
|---|---|---|---|
| CA | 2016102 | A1 | 11/1990 |
| GB | 138514 | A | 2/1920 |

(Continued)

*Primary Examiner* — Basil Katcheves

(57) ABSTRACT

A tile installation tool comprising a base defining substantially opposed base first and second end edges and a longitudinal axis extending therebetween; and a screeding element including a central portion and first and second screeding protrusions extending therefrom away from the central portion along respectively first and second directions that are angled relative to each other, the first and second screeding protrusions having different dimensions perpendicularly to the first and second directions. The screeding element is mountable to the base in a first configuration and in a second configuration, the screeding element being substantially transversally substantially fixed relative to the base in both the first and second configurations and at least part of the first and second screeding protrusions protruding substantially longitudinally from the base first end edge with the screeding element selectively movable substantially longitudinally relative to the base in the first and second configurations respectively.

20 Claims, 4 Drawing Sheets

(56) References Cited

U.S. PATENT DOCUMENTS

| | | | | |
|---|---|---|---|---|
| 5,471,758 | A * | 12/1995 | White, Sr. | 33/527 |
| 5,617,642 | A | 4/1997 | Marios | |
| 5,701,680 | A | 12/1997 | Garcia et al. | |
| D395,216 | S | 6/1998 | Figueroa | |
| 6,049,990 | A * | 4/2000 | Holland | 33/464 |
| 6,112,424 | A | 9/2000 | Friend | |
| 6,195,904 | B1 | 3/2001 | Greer | |
| 6,412,185 | B1 | 7/2002 | Mills et al. | |
| 6,481,112 | B1 | 11/2002 | White | |
| D466,380 | S | 12/2002 | Dickson | |
| 6,523,272 | B1 | 2/2003 | Morales | |
| 6,757,983 | B1 | 7/2004 | Moon | |
| 7,117,610 | B2 * | 10/2006 | Bailey | 33/526 |
| 7,159,328 | B1 | 1/2007 | Duda | |
| 7,409,773 | B1 * | 8/2008 | Gioia et al. | 33/527 |
| 7,493,704 | B2 | 2/2009 | Bailey | |
| 7,735,232 | B2 | 6/2010 | Bahler | |
| 7,748,132 | B1 | 7/2010 | Engala | |
| 8,011,163 | B2 | 9/2011 | Bazzano | |
| 2001/0018856 | A1 * | 9/2001 | Fouy | 83/467.1 |
| 2012/0131881 | A1 | 5/2012 | Pham et al. | |
| 2012/0266472 | A1 | 10/2012 | Liza | |

FOREIGN PATENT DOCUMENTS

| | | | |
|---|---|---|---|
| GB | 2036328 | A | 6/1980 |
| GB | 2167999 | A | 6/1986 |
| GB | 2174447 | A | 11/1986 |

* cited by examiner

TILE INSTALLATION TOOL

FIELD OF THE INVENTION

The present invention relates generally to construction tools and, more particularly, to a hand tool typically usable for ceramic tile installation work, and a method of using same.

BACKGROUND

Hand tools for tile installation work, such as wall or floor ceramic tiles or the like, are well known since ancient times. These tile installation hand tools are generally usable for aligning tiles and screeding at a desired height, or bed-depth, the bonding mortar typically spread along the linear space, or grout line, separating the rows of tiles. Thus, these tile installation hand tools of the prior art generally include means allowing a user to determine and adjust these spaces between the tile and bonding mortar layer therebetween.

Such means are generally represented by custom shaped pieces of wood scraps that are generally discarded after their use, or are manufactured templates offering only one custom shape.

While these prior art devices can generally fulfill the main objective of allowing a user to accomplish tile installation work, they are also inefficient in executing such task. For example, they generally represent a plurality of individual and differently shaped and sized templates that are cumbersome to handle, often usable once and discarded afterwards. Also, when no pre-manufactured tools are used, it is time-consuming and inconvenient to manually cut them out to specification from wood scraps in the first place.

Against this background, there exists a need for an improved tile installation tool. An object of the present invention is to provide such a tile installation tool.

SUMMARY OF THE INVENTION

In a broad aspect, the invention provides a tile installation tool, the tile installation tool comprising: a base defining substantially opposed base first and second end edges and a longitudinal axis extending therebetween; and a screeding element, the screeding element including a central portion and first and second screeding protrusions extending therefrom, the first and second screeding protrusions extending away from the central portion along respectively first and second directions that are angled relative to each other, the first and second screeding protrusions having different dimensions perpendicularly to the first and second directions. The screeding element is mountable to the base in a first configuration and in a second configuration, the screeding element being substantially transversally substantially fixed relative to the base in both the first and second configurations. In the first configuration, at least part of the first screeding protrusion protrudes substantially longitudinally from the base first end edge and the screeding element is selectively movable substantially longitudinally relative to the base. In the second configuration, at least part of the second screeding protrusion protrudes substantially longitudinally from the base first end edge and the screeding element is selectively movable substantially longitudinally relative to the base.

In some embodiments of the invention, the base and the screeding element are lockable relative to each other to prevent unintended substantially longitudinal movements of the screeding element relative to the base. For example, one of the base and screeding element defines a series of locking protrusions extending therefrom towards an other one of the base and screeding element and the other one of the base and screeding element defines a series of locking recesses for receiving the locking protrusions thereinto when the base and screeding element are at predetermined longitudinally spaced apart discrete positions relative to each other so that the base and screeding element remain in a longitudinally fixed relative position unless a force large enough to remove the locking protrusions from the locking recesses is exerted. In another example, one of the base and screeding element includes a threaded shaft; and an other one of the base and screeding element defines a locking slot extending therethrough, the threaded shaft being received in the locking slot and the locking slot extending substantially longitudinally when the screeding element is mounted to the base in the first configuration; the tile installation tool further comprising a locking nut threadable on the threaded shaft to compress the screeding element and the base towards each other to longitudinally lock the screeding element and the base relative to each other.

In some embodiments of the invention, the first and second directions are substantially perpendicular to each other.

In some embodiments of the invention, the screeding element further includes third and fourth screeding protrusions extending from the central portion respectively substantially opposed to the first and second screeding protrusions; the screeding element is mountable to the base in a third configuration and in a fourth configuration, the screeding element being substantially transversally substantially fixed relative to the base in both the third and fourth configurations. In the third configuration, at least part of the third screeding protrusion protrudes substantially longitudinally from the base first end edge and the screeding element is selectively movable substantially longitudinally relative to the base; and in the fourth configuration, at least part of the fourth screeding protrusion protrudes substantially longitudinally from the base first end edge and the screeding element is selectively movable substantially longitudinally relative to the base.

In some embodiments of the invention, the base defines a pair of substantially laterally substantially opposed guiding grooves extending substantially longitudinally substantially parallel to each other between the base first and second end edges and opening towards each other, the guiding grooves receiving each at least part of a respective one of the second and fourth screeding protrusions in the first and third configurations, the guiding grooves receiving each at least part of a respective one of the first and third screeding protrusions in the second and fourth configurations.

In some embodiments of the invention, the at least part of the second and fourth screeding protrusions are substantially snuggly slidably received in the guiding grooves in the first and third configurations and the at least part of the first and third screeding protrusions are substantially snuggly slidably received in the guiding grooves in the second and fourth configurations.

In some embodiments of the invention, the base defines an end wall extending across the guiding grooves substantially adjacent the base second end edge.

In some embodiments of the invention, the screeding element is substantially cross-shaped.

In some embodiments of the invention, the first, second, third and fourth screeding elements define respectively first, second, third and fourth screeding edges substantially opposed to the central portion, the first, second, third and fourth screeding edges extending substantially perpendicular to the longitudinal axis respectively in the first, second, third and fourth configurations.

In some embodiments of the invention, the base first end edge is substantially rectilinear and substantially perpendicular to the longitudinal axis.

In some embodiments of the invention, the first screeding protrusion is provided with spaced apart indicia indicative of an extent by which the first screeding protrusion protrudes substantially longitudinally from the base first end edge in the first configuration.

In some embodiments of the invention, the base first end edge is provided with laterally spaced apart indicia indicative of a position of the base relative to structures along which the base is moved when using the tile installation tool to screed with the screeding element.

In some embodiments of the invention, the first screeding protrusion defines a screeding edge opposed to the central portion, the screeding edge being crenelated.

In some embodiments of the invention, the base includes a handle for improving gripping of the tile installation tool.

For example, the handle includes longitudinally spaced apart transversally extending ridges protruding from the base opposed to the screeding element.

In some embodiments of the invention, the screeding element is substantially plate-shaped.

In some embodiments of the invention, the base defines a pair of substantially opposed base side edges extending between the base first and second end edges, at least one of the base side edges being crenelated.

In some embodiments of the invention, the first screeding protrusion defines a screeding edge, the screeding edge being beveled.

In some embodiments of the invention, the base first end edge is beveled.

In some embodiments of the invention, the first and second screeding protrusions extend integrally as a single piece of material from the central portion.

The tile installation tool is usable during tile installation work as a bed-width gauge, a bed-depth gauge and a screeding tool that can be manually passed or swiped along the elongated space, or grout line, between aligned rows of wall or floor tiles and typically filled with tile bonding mortar.

The tile installation tool is manufacturable at relatively low costs and reusable in some embodiments.

Other objects, advantages and features of the present invention will become more apparent upon reading of the following non-restrictive description of some embodiments thereof, given by way of example only with reference to the accompanying drawings.

DETAILED DESCRIPTION

Figure 10:
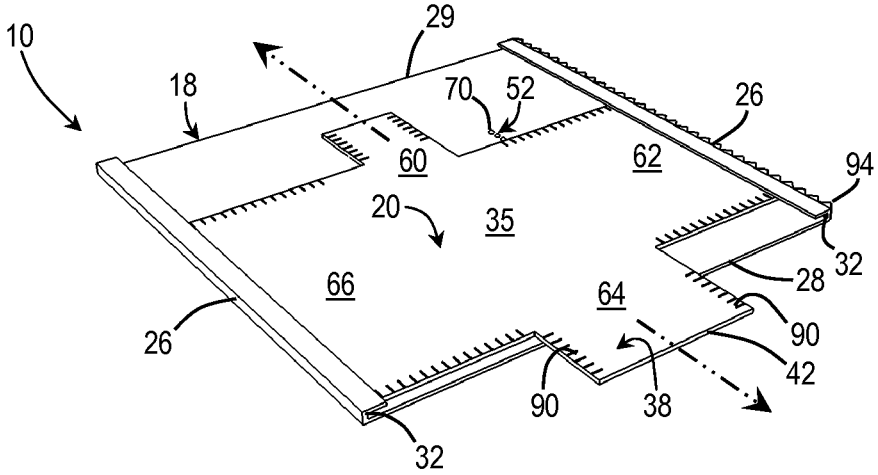
FIG. 10, in perspective view, illustrates the multifunction tile installation tool of FIG. 1.

FIGS. 1 to 8 inclusively, and FIG. 10, show various aspects of an embodiment of a tile installation tool 10 according to the present invention.

Figure 1:
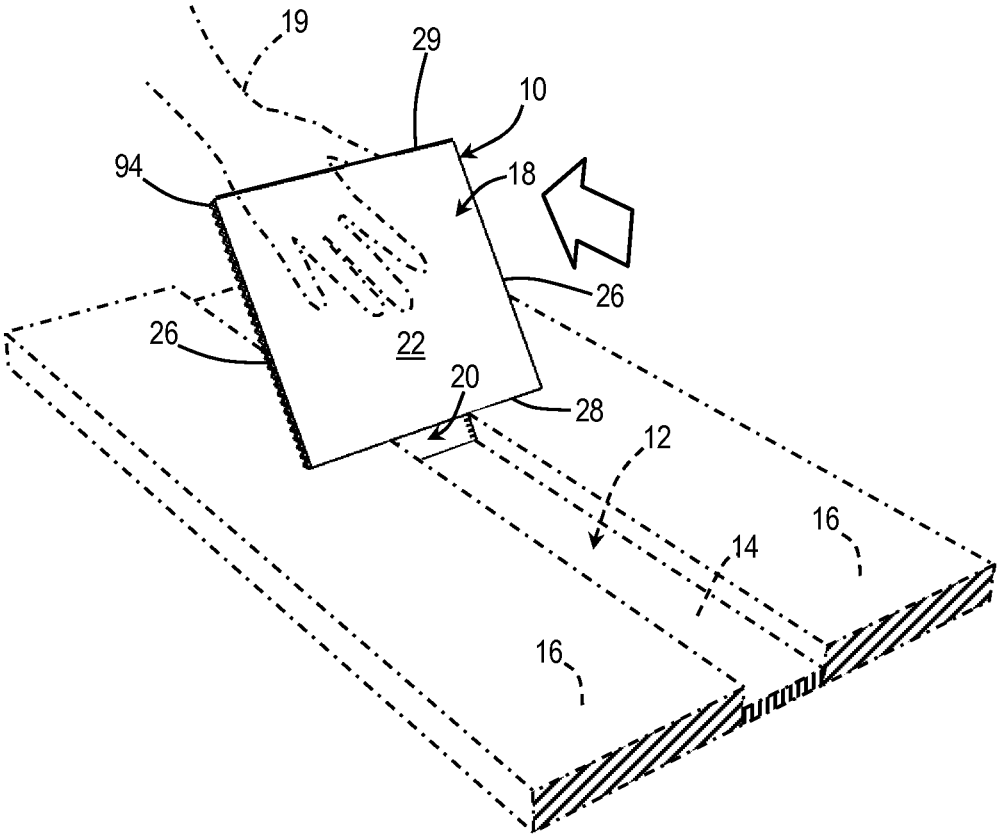
FIG. 1, in a perspective environmental view, illustrates an embodiment of a tile installation tool according to the present invention.
Figure 8:
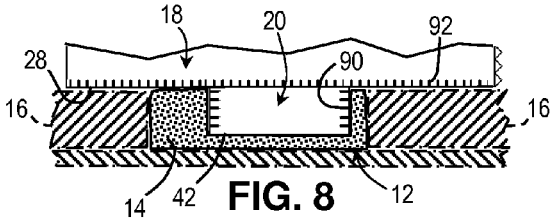
FIG. 8, in a partial top plan view, illustrates the tile installation tool of FIG. 1, here shown engaged in a grout line between tiles.

As best illustrated in FIGS. 1 and 8, the tile installation tool 10 is usable during tile installation work as a bed-width gauge, a bed-depth gauge and a screeding tool that can be manually passed or swiped along the elongated space, or grout line 12, between aligned rows of wall, floor and ceiling tiles 16 and typically filled with tile bonding mortar 14.

Now generally referring to FIG. 1, the tile installation tool 10 includes a base 18 and a screeding element 20. In use, the base 18, is held by the hand 19 of the user of the tile installation tool 10 and the screeding element 20 is used to screed the bonding mortar 14.

Figure 5:
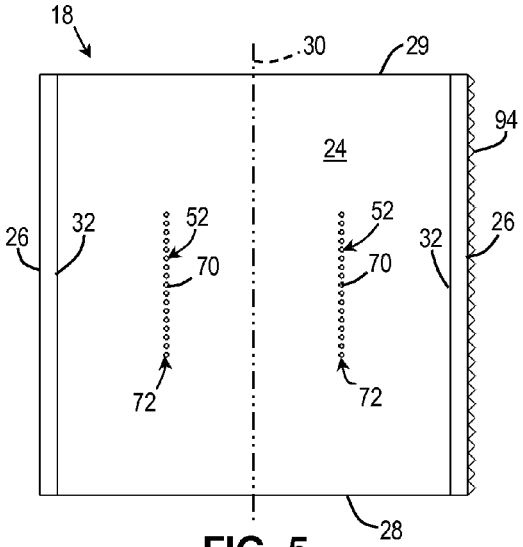
FIG. 5, in a top plan view, illustrates a base part of the tile installation tool of FIG. 1.

The base 18 defines substantially opposed base first and second end edges 28 and 29 and a longitudinal axis 30 (seen in FIG. 5) extending therebetween. The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art. The base first and second end edge 28 and 29 may be generally rectilinear or be at least partially curved. Typically, the base first end edge 28 is substantially rectilinear, as seen for example in FIG. 1. In the specific embodiment of the invention shown in FIG. 1, the base second end edge 29 is also substantially rectilinear. Also, the presence of a longitudinal axis 30 does not imply that the tile installation tool 10 is elongated along the longitudinal axis 30. For example, as seen in FIG. 5, the base 18 may be substantially square. Instead, the term "longitudinal" refers to a specific direction along which the base 18 and the screeding element 20 are moved relative to each other, as described hereinbelow.

Figure 2:
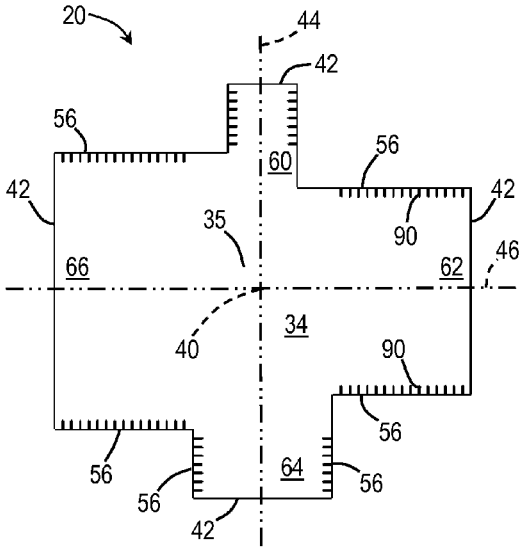
FIG. 2, in a top plan view, illustrates a screeding element part of the tile installation tool shown in FIG. 1.

A seen for example in FIG. 2, the screeding element 20 includes a central portion 35 and first and second screeding protrusions 60 and 62 extending therefrom. In the specific embodiments or the invention shown in the drawings, the screeding element 20 also includes third and fourth screeding protrusions 64 and 66 extending from the central portion 35 respectively substantially opposed respectively to the first and second screeding protrusions 60 and 62. In this embodiment, the screeding element 20 is typically substantially cross-shaped. However, screeding elements 20 in which screeding protrusions 64 and 66 are omitted and in which instead the central portion 35 extends to the edges of the screeding element 20 opposed to the first and second screeding protrusions 60 and 62 are within the scope of the invention.

The first and second screeding protrusions 60 and 62 extend away from the central portion 35 along respectively first and second directions 44 and 46 that are angled relative to each other. The first and second screeding protrusions 60 and 62 have different dimensions in a direction perpendicular to the first and second directions 44 and 46. The first and second directions 44 and 46 (also referred to as the first and second axes 44 and 46 herein) are typically substantially perpendicular to each other, but other orientations are within the scope of the invention if the first, second, third and fourth screeding protrusions 60, 62, 64 and 66 are appropriately shaped.

The screeding element 20 is mountable to the base 18 in a first configuration and in a second configuration. The screeding element 20 is substantially transversally substantially fixed relative to the base 18 in both the first and second configurations. For the purpose of this document, transversal refers to any direction perpendicular to the longitudinal axis 30. Also, substantially fixed refers to a condition in which the screeding element 20 does not move relative to the base 18, or moves only slightly under external forces, so that when in use, there is no or inconsequential relative movements therebetween. When present, such movements allow screeding with a precision that is sufficient to provide aesthetic relative positioning between tiles 16. Therefore, when in the first and second configurations, the only large movements allowed are longitudinal movements, along the longitudinal axis 30, between the screeding element 20 and the base 18. As described in further details hereinbelow, in some embodiments of the invention, such movements are only allowed selectively to facilitate use of the tile installation tool 10.

In the first configuration, at least part of the first screeding protrusion 60 protrudes substantially longitudinally from the base first end edge 28 and the screeding element 20 is selectively movable substantially longitudinally relative to the base 18. In the second configuration, at least part of the second screeding protrusion 62 protrudes substantially longitudinally from the base first end edge 28 and the screeding element 20 is selectively movable substantially longitudinally relative to the base 18. Therefore, selective adjustment of the amount of the first and second screeding protrusions 60 and 62 that protrudes from the base 18 at the base first end edge 28 may be made respectively in the first and second configurations. While the drawings only show the tile installation tool in one configuration, more than one configuration is shown for an alternative tile installation tool 210 described in further details hereinbelow.

In the embodiments of the invention shown in FIGS. 1 to 10, the screeding element 20 is mountable to the base 18 in a third configuration and in a fourth configuration. The screeding element 20 is substantially transversally substantially fixed relative to the base 18 in both the third and fourth configurations. In the third and fourth configurations respectively, at least part of the third and fourth screeding protrusion 64 and 66 protrudes substantially longitudinally from the base first end edge 28 and the screeding element 20 is selectively movable substantially longitudinally relative to the base 18 to selectively vary an amount by which the third and fourth screeding protrusions 64 and 66 protrude from the base 18 at the base first end edge 28.

Referring for example to FIG. 10, a pair of guides 32 are attached to, or integrally formed with, opposite longitudinal side edges of the base 18 and receive the screeding element 20 in the first and second configurations, and if applicable, in the third and fourth configurations. For example the base 18 defines a pair of substantially parallel, substantially laterally substantially opposed guides 32 in the form of guiding grooves 32 extending substantially longitudinally between the base first and second end edges 28 and 29 and opening towards each other. The guiding grooves 32 receive each at least part of a respective one of the second and fourth screeding protrusions 62 and 66 in the first and third configurations and the guiding grooves 32 receive at least part of a respective one of the first and third screeding protrusions 60 and 64 in the second and fourth configurations. For example, the first, second, third and fourth screeding protrusions 60, 62, 64 and 66 are snuggly slidably received in the guiding grooves 52.

Typically, the base 18 and the screeding element 20 are lockable relative to each other to prevent unintended substantially longitudinal movements of the screeding element 20 base first and second end edges 18 relative to the base 18. This locking action may be achieved in any suitable manner.

In a first example, as seen in FIG. 5, one of the base 18 and screeding element 20, in the present case the base 18, defines a series of locking protrusions 70 extending therefrom towards an other one of the base 18 and screeding element 20, here the screeding element 20. For example, substantially rounded locking protrusions 70 are equidistantly spaced apart along a pair of protrusion linear rows 72 that are each extending on at least a portion of the base inner surface 24, in other words the surface that faces the screeding element 20 in an operational configuration. The protrusion linear rows 72 are parallelly disposed and equidistantly spaced apart on each side of the longitudinal axis 30.

Figure 3:
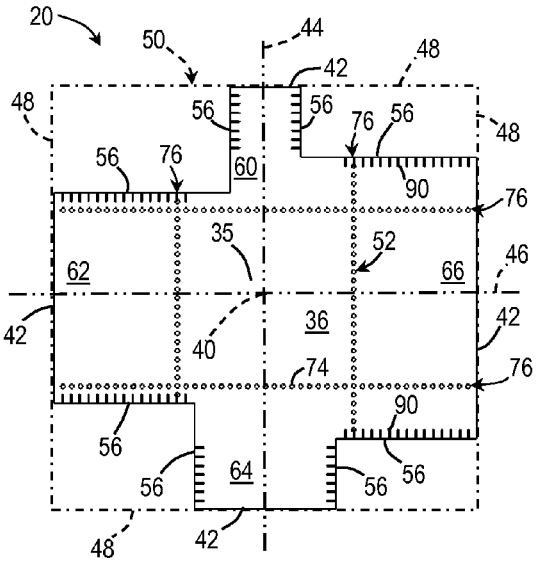
FIG. 3, in a bottom plan view, illustrates screeding element of FIG. 2.
Figure 4:
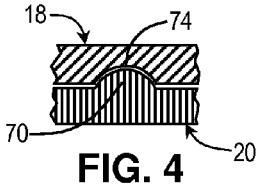
FIG. 4, in a partial cross-sectional view, illustrates a pair of mutually engaged locking protrusion and locking recess formed in the tile installation tool of FIG. 1.

As seen in FIG. 3, the other one of the base 18 and screeding element 20, here the screeding element 20, defines a series of locking recesses 74 for receiving the locking protrusions 70 thereinto when the base 18 and screeding element 20 are at predetermined longitudinally spaced apart discrete positions relative to each other so that the base 18 and screeding element 20 remain in a longitudinally fixed relative position unless a force large enough to remove the locking protrusions 70 from the locking recesses 74 is exerted. For example, rounded locking recesses 74 are shaped, sized and equidistantly spaced apart from one another relative to the rounded locking protrusions 70 and have shaped that are complementary thereto, as seen in FIG. 4.

Referring to FIG. 3, the locking recesses 74 are typically disposed in two pairs of recesses linear rows 76. Each one of the recesses linear rows 76 of a first one of the pair are equidistantly spaced apart on each side of a screeding element first axis 44 such that they are in register with the pair of protrusion linear rows 72, and extending linearly parallelly therealong substantially throughout the whole dimension of the screeding element 20. Each one of the recesses linear rows 76 of the second pair of recesses linear rows 76 are equidistantly spaced apart on each side of a screeding element second axis 46 in a similar manner as the first pair, but extending perpendicularly relative thereto.

Thus the relative linear position of the screeding element 20 relative to the longitudinal axis of the base 18 may be user removably fixed by equal incremental steps corresponding to the distance between two of the locking protrusions 70, or equivalently between two of the locking recesses 74. In a specific and non-limiting example, the distance separating two adjacent locking protrusions 70 and, consequently, two adjacent locking recesses 74 is $1/8^{th}$ of an inch. Other distance values are also possible.

As would be obvious to someone versed in the art, in an alternate embodiment of a tile installation tool (not shown in the drawings), according to the present invention, the base 18 comprises a single row of locking protrusions 70 longitudinally aligned on the longitudinal axis 30 of the base 18, and two rows of locking recesses 74 perpendicularly intersect at the screeding element center point 40 of the screeding element 20. Furthermore, it is to be understood that an identical disposition of locking recesses 74 as described above may as well be provided on both sides of the screeding element 20.

Figure 11:
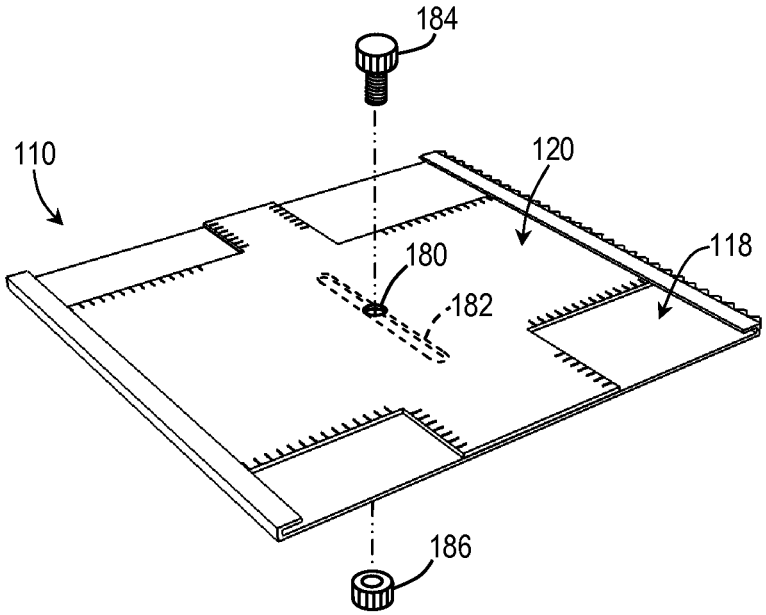
FIG. 11, in a perspective exploded view, illustrates an alternate embodiment of a tile installation tool in accordance with the invention.

The locking action may also be provided for example as seen in FIG. 11 for an alternative tile installation tool 110. In this example, one of the base 118 and screeding element 120, here the screeding element 120, includes a threaded shaft which may, for example, be integrally formed therewith, permanently secured thereto or take the form of a nut 184 inserted in a locking aperture 180 formed through the screeding element 120, in the present case, or through the base 118, the locking aperture 180 being dimensioned to prevent the nut 184 from completely passing therethrough. The other one of the base 118 and screeding element 120 defines a locking slot 182 extending therethrough, the threaded shaft 184 being received in the locking slot 182 and the locking slot 182 extending substantially longitudinally when the screeding element 120 is mounted to the base 118 in the first configuration. The tile installation tool 110 further comprises a locking nut 186 threadable on the threaded shaft 184 to compress the screeding element 120 and the base 118 towards each other to longitudinally lock the screeding element 120 and the base 118 relative to each other.

The base 18 and 118 and screeding element 20 and 120, and when present the threaded shaft 184 and locking nut 186, are typically made of a sufficiently rigid material. For example, the base 18 and the screeding element 20 may be made of suitably rigid and rust proof metal sheets using a conventional punch-press process, a suitably rigid polymeric or plastic material using an injection molding process, or a combination of these materials using the appropriate manufacturing processes.

Now referring to FIG. 5, the base 18 has for example a substantially planar and square shaped plate configuration defining parallel base outer and inner surfaces 22 and 24 (the latter being seen in FIG. 1) and a pair of substantially opposed and parallelly disposed base side edges 26 extending between the base first and second end edges 28 and 29, typically substantially perpendicularly relative thereto. The guiding grooves 32 are provided typically substantially adjacent a respective one of the base side edges 26.

Figure 6:
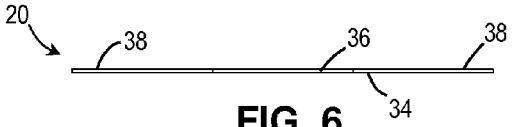
FIG. 6, in a front elevational view, illustrates the screeding element of FIGS. 3 and 4.
Figure 7:
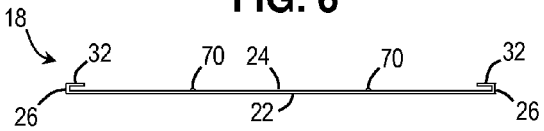
FIG. 7, in a front elevational view, illustrates the base of FIG. 5.

Now referring to FIGS. 2, 3 and 6, the screeding element 20 is substantially planar. The screeding element 20 defines substantially parallel screeding element front and back surfaces 34 and 36 respectively, as better seen in FIG. 6. Typically, the first, second, third and fourth screeding protrusions 60, 62, 64 and 66 extend integrally as a single piece of material from the central portion 35.

Figure 9:
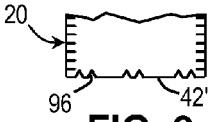
FIG. 9, in a partial top plan view, illustrate an alternate embodiment of a screeding element usable in the tile installation tool of FIG. 1.

Referring to FIGS. 2 and 3, the first, second, third and fourth screeding protrusions 60, 62, 64 and 66 each forms a gauge template extending away from an imaginary screeding element center point 40. Furthermore, each one of the first, second, third and fourth screeding protrusions 60, 62, 64 and 66 defines a screeding edge 42 opposed to the central portion 35. In some embodiments, as seen in FIG. 9, the screeding edge 42' is crenelated, but straight or otherwise shaped screeding edges 42 are within the scope of the invention. The screeding edges 42 extend substantially linearly perpendicularly relative to the first and second directions 44 and 46, which intersect at the imaginary screeding element center point 40 and extend centrally through each one of two oppositely disposed ones of the first, second, third and fourth screeding protrusions 60, 62, 64 and 66.

All four screeding edges 42 are typically further at an equal distance apart from the imaginary screeding element center point 40. Thus each one of the screeding edges 42 defines an edge axis 48 extending therealong, which edge axes 48 are intersecting to cooperatively form an imaginary equal-sided square outline 50 circumscribing the screeding element 20. The imaginary equal-sided square outline 50 and, thus, the square-shaped overall dimension of the screeding element 20, is suitably dimensioned for allowing the screeding element 20 to freely slidably engage in a substantially snug fit relation the guiding grooves 32.

With the screeding element 20 slidably engaged in the guiding grooves 32 of the base 18 such that one of the screeding edges 42 is at least slightly protruding from the base first end edge 28, as illustrated in FIGS. 1 and 8, a user may grab the tile installation tool 10 with at least one hand 19 from an opposite portion thereof, and use the latter for tile installation work as best illustrated in FIG. 1.

Now referring to FIGS. 2 and 3, in some embodiments of the invention, each one of the first, second, third and fourth screeding protrusions 60, 62, 64 and 66 has a width dimension comprised between roughly 1/16 of an inch and a width dimension that is at least slightly smaller than a full width of the imaginary equal-sided square outline 50, the first, second, third and fourth screeding protrusions 60, 62, 64 and 66 having a different width dimensions. Typically, each one of the first, second, third and fourth screeding protrusions 60, 62, 64 and 66 is further substantially centrally disposed relative to the full width of the imaginary equal-sided square outline 50.

Furthermore, each one of the first, second, third and fourth screeding protrusions 60, 62, 64 and 66 defines a pair of screeding protrusion side edges 56 extending substantially parallelly inwardly relative to the screeding edges 42 until the screeding protrusion side edges 56 intersect with adjacent and perpendicularly extending screeding protrusion side edges 56. The first, second, third and fourth screeding protrusions 60, 62, 64 and 66 are therefore typically substantially rectangular.

As best illustrated in FIG. 2, the outer square shaped dimension of the screeding element 20 is for example, and non-limitingly six (6) inches by side, with the first, second, third and fourth screeding protrusions 60, 62, 64 and 66 having a screeding edge 42 having a length of respectively one (1), two (2), three (3) and four (4) inches. It is to be understood that other relative orders and relative width proportions between the first, second, third and fourth screeding protrusions 60, 62, 64 and 66 around the screeding element 20 are also possible.

As best illustrated in FIG. 2, in some embodiments of the tile installation tool 10, one of or both screeding protrusion side edges 56 of each of the first, second, third and fourth screeding protrusions 60, 62, 64 and 66 is provided with is provided with spaced apart indicia 90 indicative of an extent by which the first, second, third and fourth screeding protrusions 60, 62, 64 and 66 protrudes substantially longitudinally from the base first end edge 28 in the first, second, third and fourth configurations respectively. The indicia 90 include for example graduated markings 90 extending substantially the whole length of the screeding protrusion side edges 56. The indicia 90 may be particularly useful for screeding operations of bonding mortar at a predetermined bed-depth of a grout line 12.

Furthermore, the indicia 90 are for example disposed therealong such that each individual marking coincide with an incremental step of the position of the screeding element 20 relative to the base 18 provided by the engaging locking protrusions 70 and locking recesses 74.

In some embodiments, as illustrated in FIG. 8, the base first end edge 28 is provided with laterally spaced apart indicia 92 indicative of a position of the base 18 relative to structures along which the base 18 is moved when using the tile installation tool 10 to screed with the screeding element 20. The indicia 92 may take the form of graduated markings that are extending along substantially the whole length of the base first end edge 28. The indicia 92 may be useful for providing a measuring reference of the lateral position of the first, second, third and fourth screeding protrusions 60, 62, 64 and 66 between two tiles 16, more particularly so when the channel created along the grout line 12 by the first, second, third and fourth screeding protrusions 60, 62, 64 and 66 must be at a constant offset on one side thereof as illustrated in FIG. 8.

As illustrated in FIG. 5, in some embodiments, at least one of the base side edges 26 in crenelated and as such comprises a series of teeth 94 extending perpendicularly therefrom. The series of teeth 94 may be conveniently used for removing trapped air bubbles from a layer of bonding mortar 14.

As best illustrated in FIG. 9, in some embodiments, at least one of the screeding edges 42' is crenelated and defines at least one inwardly extending recess 96 usable, for example, for forming a ridge pattern along the surface of a tile bonding mortar 14.

Figure 12:
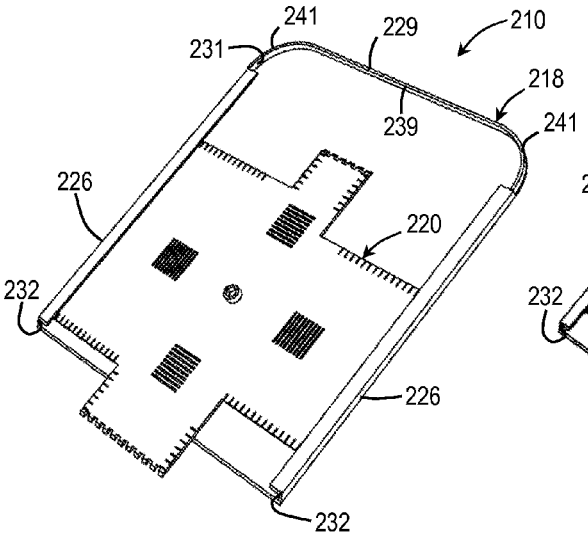
FIG. 12, in a perspective view, illustrates another alternate embodiment of a tile installation tool in accordance with the invention, here shown in a first configuration.
Figure 13:
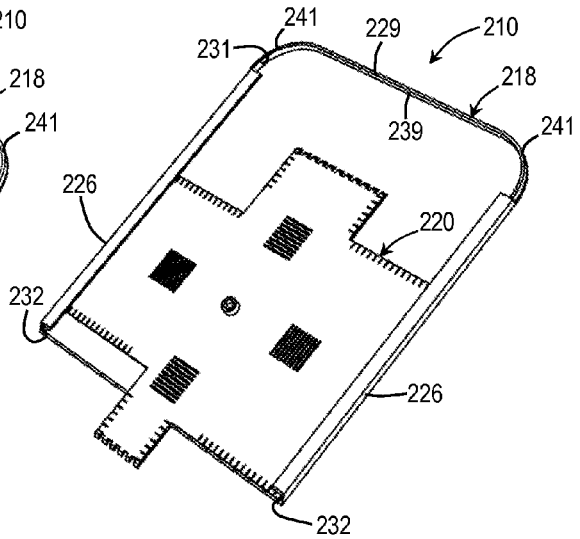
FIG. 13, in a perspective view illustrate the tile installation tool of FIG. 12 in a second configuration.
Figure 14:
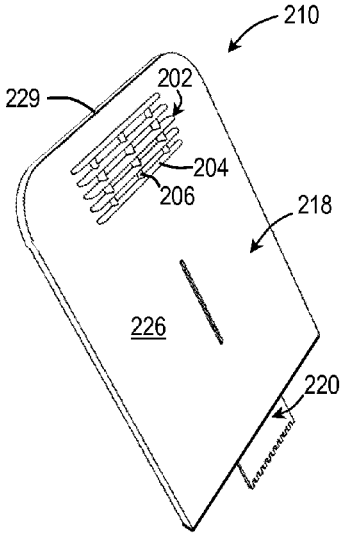
FIG. 14, in a bottom plan view, illustrates the tile installation tool of FIGS. 12 and 13.

FIGS. 12 to 14 illustrate another embodiment of a tile installation tool 210 in accordance with the invention. The tile installation tool 210 is similar to the tile installation tools 10 and 110 and only the differences therebetween are described hereinbelow. In the following description, components of the tile installation tool 210 with a reference numeral over 200 are similar in shape and function to those with reference numerals below 100 and having the same last two digits, unless mentioned otherwise. FIGS. 12 and 13 illustrate the tile installation tool 210 in two different configurations, with the screeding element 220 thereof inserted in the guiding grooves 232 in two different orientations.

Referring to FIGS. 12 and 13, a first element specific to the tile installation tool 210 consists in the presence of an end wall 231 in the base 218, the end wall 231 extending across the guiding grooves 232 substantially adjacent the base second end edge 229. The latter is not rectilinear, but instead includes a central rectilinear portion 239 that merges with the base side edges 226 along arcuate portions 241.

Also, referring to FIG. 14, the base 218 includes a handle 202 for improving gripping of the tile installation tool 210. For example, the handle 202 includes longitudinally spaced apart transversally extending handle ridges 204 protruding from the base 218 opposed to the screeding element 220, that is from the base outer surface 222. Linking ridges 206 may also extend between adjacent ones of the handle ridges.

Figure 15:
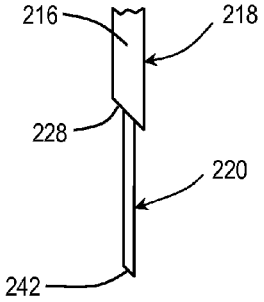
FIG. 15, in a partial side elevation view, illustrates the tile installation tool of FIGS. 12 to 14.

Some embodiments of the invention, as shown in FIG. 15, the installation tool 210 has at least one of the screeding edges 242 thereof beveled and the base first end edge 228 thereof also beveled. It should be noted that any number and combination of the screeding edges 242 and base first end edge 228 may be beveled, with the other ones at 90 degrees with adjacent surfaces. Also, this beveled configuration may be present in any of the other tiling tools described in the present document. This beveled configuration is useful to better reach junctions between walls or walls and floors when the tiling tool is used. Typically, the beveled configuration is at about 45 degrees relative to the main surfaces of the installation tool 210, but any other suitable angle is within the scope of the invention.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A tile installation tool, said tile installation tool comprising:

a base defining substantially opposed base first and second end edges and a longitudinal axis extending therebetween; and a screeding element, said screeding element including a central portion and first and second screeding protrusions extending therefrom, said first and second screeding protrusions extending away from said central portion along respectively first and second directions that are angled relative to each other, said first and second screeding protrusions having different dimensions perpendicularly to said first and second directions;

said screeding element further including third and fourth screeding protrusions extending from said central portion respectively substantially opposed to said first and second screeding protrusions;

said screeding element being mountable to said base in a first configuration and in a second configuration, said screeding element being substantially transversally substantially fixed relative to said base in both said first and second configurations, said screeding element being also mountable to said base in a third configuration and in a fourth configuration, said screeding element being substantially transversally substantially fixed relative to said base in both said third and fourth configurations, wherein said first and second directions are substantially perpendicular to each other;

in said first configuration, at least part of said first screeding protrusion protrudes substantially longitudinally from said base first end edge and said screeding element is selectively movable substantially longitudinally relative to said base; and in said second configuration, at least part of said second screeding protrusion protrudes substantially longitudinally from said base first end edge and said screeding element is selectively movable substantially longitudinally relative to said base;

in said third configuration, at least part of said third screeding protrusion protrudes substantially longitudinally from said base first end edge and said screeding element is selectively movable substantially longitudinally relative to said base; and in said fourth configuration, at least part of said fourth screeding protrusion protrudes substantially longitudinally from said base first end edge and said screeding element is selectively movable substantially longitudinally relative to said base.

2. A tile installation tool as defined in claim 1, wherein said base and said screeding element are lockable relative to each other to prevent unintended substantially longitudinal movements of said screeding element relative to said base.

3. A tile installation tool as defined in claim 2, wherein one of said base and screeding element defines a series of locking protrusions extending therefrom towards an other one of said base and screeding element and said other one of said base and screeding element defines a series of locking recesses for receiving said locking protrusions thereinto when said base and screeding element are at predetermined longitudinally spaced apart discrete positions relative to each other so that said base and screeding element remain in a longitudinally fixed relative position unless a force large enough to remove said locking protrusions from said locking recesses is exerted, wherein said locking protrusions are substantially longitudinally spaced apart from each other and substantially laterally aligned with each other; and said locking recesses are substantially longitudinally spaced apart from each other and substantially laterally aligned with each other.

4. A tile installation tool as defined in claim 2, wherein one of said base and screeding element includes a threaded shaft; and an other one of said base and screeding element defines a locking slot extending therethrough, said threaded shaft being received in said locking slot and said locking slot extending substantially longitudinally when said screeding element is mounted to said base in said first configuration;

said tile installation tool further comprising a locking nut threadable on said threaded shaft to compress said screeding element and said base towards each other to longitudinally lock said screeding element and said base relative to each other.

5. A tile installation tool as defined in claim 1, wherein said base defines a pair of substantially parallel substantially laterally substantially opposed guiding grooves extending substantially longitudinally between said base first and second end edges and opening towards each other; said guiding grooves receiving each at least part of a respective one of said second and fourth screeding protrusions in said first and third configurations, said guiding grooves receiving each at least part of a respective one of said first and third screeding protrusions in said second and fourth configurations.

6. A tile installation tool as defined in claim 5, wherein said at least part of said second and fourth screeding protrusions are substantially snuggly slidably received in said guiding grooves in said first and third configurations and said at least part of said first and third screeding protrusions are substantially snuggly slidably received in said guiding grooves in said second and fourth configurations.

7. A tile installation tool as defined in claim 5, wherein said base defines an end wall extending across said guiding grooves substantially adjacent said base second end edge.

8. A tile installation tool as defined in claim 1, wherein said screeding element is substantially cross-shaped.

9. A tile installation tool as defined in claim 1, wherein said first, second, third and fourth screeding elements define respectively first, second, third and fourth screeding edges substantially opposed to said central portion, said first, second, third and fourth screeding edges extending substantially perpendicular to said longitudinal axis respectively in said first, second, third and fourth configurations.

10. A tile installation tool as defined in claim 1, wherein said base first end edge is substantially rectilinear and substantially perpendicular to said longitudinal axis.

11. A tile installation tool as defined in claim 1, wherein said first screeding protrusion is provided with spaced apart indicia indicative of an extent by which said first screeding protrusion protrudes substantially longitudinally from said base first end edge in said first configuration.

12. A tile installation tool as defined in claim 1, wherein said base first end edge is provided with laterally spaced apart indicia indicative of a position of said base relative to structures along which said base is moved when using said tile installation tool to screed with said screeding element.

13. A tile installation tool as defined in claim 1, wherein said first screeding protrusion defines a screeding edge opposed to said central portion, said screeding edge being crenelated.

14. A tile installation tool as defined in claim 1, wherein said base includes a handle for improving gripping of said tile installation tool.

15. A tile installation tool as defined in claim 14, wherein said handle includes longitudinally spaced apart transversally extending ridges protruding from said base opposed to said screeding element.

16. A tile installation tool as defined in claim 1, wherein said screeding element is substantially plate-shaped.

17. A tile installation tool as defined in claim 1, wherein said base defines a pair of substantially opposed base side edges extending between said base first and second end edges, at least one of said base side edges being crenelated.

18. A tile installation tool as defined in claim 1, wherein said first and second screeding protrusions extend integrally as a single piece of material from said central portion.

19. A tile installation tool as defined in claim 1, wherein said first screeding protrusion defines a screeding edge, said screeding edge being beveled.

20. A tile installation tool as defined in claim 1, wherein said base first end edge is beveled.

* * * * *